US007663308B2

(12) United States Patent
Yi et al.

(10) Patent No.: US 7,663,308 B2
(45) Date of Patent: Feb. 16, 2010

(54) PLASMA DISPLAY PANEL

(75) Inventors: Jeong-Doo Yi, Yongin-si (KR); Yoon-Hyoung Cho, Yongin-si (KR); Jeong-Nam Kim, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 510 days.

(21) Appl. No.: 11/504,656

(22) Filed: Aug. 16, 2006

(65) Prior Publication Data

US 2007/0040497 A1 Feb. 22, 2007

(30) Foreign Application Priority Data

Aug. 16, 2005 (KR) ..... 10-2005-0074781

(51) Int. Cl.
*H01J 1/62* (2006.01)

(52) U.S. Cl. ..... 313/506; 313/582; 313/583; 313/587

(58) Field of Classification Search ..... 313/582–587; 315/169.3, 169.4; 345/60, 30, 37; 445/24
See application file for complete search history.

(56) References Cited

U.S. PATENT DOCUMENTS 6,548,962 B1 * 4/2003 Shiokawa et al. ..... 315/169.4
2002/0008474 A1 * 1/2002 Kurogi et al. ..... 313/584
2004/0135509 A1 * 7/2004 Kwon et al. ..... 313/584
2005/0062422 A1 * 3/2005 Sasaki et al. ..... 313/587
2006/0158112 A1 * 7/2006 Hur et al. ..... 313/582

FOREIGN PATENT DOCUMENTS

KR 2001-0026193 * 4/2001

* cited by examiner

*Primary Examiner*—Toan Ton
*Assistant Examiner*—Elmito Breval
(74) *Attorney, Agent, or Firm*—Lee & Morse, P.C.

(57) ABSTRACT

A plasma display panel may include a first substrate, a second substrate opposite to the first substrate with a predetermined space therebetween, the space being partitioned into a plurality of discharge cells, a phosphor layer formed in the discharge cells, address electrodes extending in a first direction on the first substrate to correspond to the discharge cells, and a first electrode and a second electrode extending in a second direction crossing the first direction at the first substrate side, spaced apart from the address electrodes, formed opposite to each other, and projecting toward the second substrate with a discharge space formed therebetween, wherein the address electrodes include protrusions disposed adjacent to the second electrodes and protruding toward the inside of the discharge cells, and wherein at least one of the first electrode and the second electrode includes protrusions protruding toward an inside of a respective one of the discharge cells.

20 Claims, 6 Drawing Sheets

PLASMA DISPLAY PANEL

BACKGROUND OF THE INVENTION

1. Field of the Invention

The invention relates to plasma display panels (PDPs). More particularly, the invention relates to PDPs having improved luminous efficiency and reduced driving voltage.

2. Description of the Related Art

Generally, a plasma display panel (hereinafter referred to as "PDP") is a display device that displays images with red (R), green (G), and blue (B) visible light that is generated by exciting phosphor with vacuum ultraviolet (VUV) rays radiated by plasma during gas discharge.

PDPs generally enable display devices having a relatively wide screen of, e.g., greater than 60 inches, and a relatively thin thickness of, e.g., less than 10 cm. PDPs generally have characteristics of excellent color representation and wide-viewing angles, i.e., no distortion resulting from a viewing angle, as a PDP is generally a self-emissive display element like a cathode ray tube (CRT).

PDPs are generally advantages with regard to production cost because PDPs have a relative simple fabrication method as compared to that of liquid crystal displays (LCDs). Due to such advantages, PDPs may be more suitable for industrial-use flat panel displays and televisions display for home use in the future.

A three-electrode surface-discharge type is one-type of structure that may be employed in a PDP. The three-electrode surface-discharge structure may include a front substrate and a rear substrate maintaining a space therebetween, display electrodes, i.e., scan and sustain electrodes, on the front substrate, and address electrodes on the rear substrate crossing the display electrodes. The front and rear substrates may be secured and a discharge gas may be filled into the space therebetween.

An address discharge may be generated by controlling a voltage difference between a scan electrode and a corresponding address electrode crossing the scan electrode, and a sustain discharge may be generated by controlling a voltage difference between the scan electrode and a corresponding sustain electrode facing the scan electrode. The address discharge generally determines whether a discharge will occur, and the sustain discharge generally determines a brightness of the respective pixel.

When the scan electrodes are disposed on the front substrate and the address electrodes are disposed on the rear substrate, due to a relatively long discharge distance between the scan electrodes and the respective address electrodes a relatively high amount of power may be consumed to generate an address discharge.

To decrease the power consumption of the address discharge, address electrodes, scan electrodes, and sustain electrodes may be formed on the front substrate such that a smaller distance may exist between corresponding ones of the scan and address electrodes. The scan and sustain electrodes may be configured to have an opposing discharge structure, and may be shared by a pair of adjacent discharge cells, respectively.

However, the opposing discharge structure may cause a discharge gap between the sustain electrodes and the scan electrodes to increase, thereby increasing a driving voltage of the PDP.

The above information disclosed in this Background section is provided only for the purpose of aiding and enhancing an understanding of a basis and background of the invention, and does not constitute, and is not to be interpreted as, an admission or statement as to what is or is not considered or constitutes prior art relative to the invention.

SUMMARY OF THE INVENTION

The invention is therefore directed to electrode structures and plasma display panels (PDPs) employing such electrode structures, which substantially overcome one or more of the problems due to the limitations and disadvantages of the prior art.

It is therefore a feature of an embodiment of the invention to provide a PDP having an improved luminous efficiency.

It is therefore a separate feature of an embodiment of the invention to provide a PDP having a reduced driving voltage.

At least one of the above and other features and advantages of the invention may be realized by providing a plasma display panel, including a first substrate, a second substrate opposite to the first substrate with a predetermined space therebetween, the space being partitioned into a plurality of discharge cells, a phosphor layer formed in the discharge cells, address electrodes extending in a first direction on the first substrate to correspond to the discharge cells, and a first electrode and a second electrode extending in a second direction crossing the first direction at the first substrate side, spaced apart from the address electrodes, formed opposite to each other, and projecting toward the second substrate with a discharge space formed therebetween, wherein the address electrodes include protrusions disposed adjacent to the second electrodes and protruding toward the inside of the discharge cells, and at least one of the first electrode and the second electrode includes protrusions protruding toward an inside of a respective one of the discharge cells.

The address electrodes may be disposed on boundaries between adjacent discharge cells in the second direction. The protrusions of the address electrodes may be formed at corners of the discharge cells. The protrusions of the address electrodes may have a triangular plan shape. The protrusions of the address electrodes may be formed to correspond to each of a pair of adjacent discharge cells in the first direction with the second electrode therebetween. The protrusions of the second electrode may be formed at corners of the discharge cells. The protrusions of the second electrode may have a triangular plan shape. The protrusions of the second electrode may be formed to correspond to the protrusions of the address electrodes.

The protrusions of the second electrode may be formed to correspond to each of a pair of adjacent discharge cells in the first direction with the second electrode therebetween. The protrusions of the second electrode may be disposed adjacent to the first substrate. The protrusions of the second electrode may be formed to correspond to each of a pair of adjacent discharge cells in the second direction. A distance between the first electrode and the protrusions of the second electrode measured in the first direction may get shorter going along a direction away from a center of the discharge cells.

The protrusions of the first electrode may be formed at corners of the discharge cells. The protrusions of the first electrode may have a triangular plan shape. The protrusions of the first electrode may be disposed opposite to the protrusions of the second electrode. The protrusions of the first electrode may correspond to each of a pair of adjacent discharge cells in the first direction with the first electrode therebetween.

A distance between the protrusions of the first electrode and the protrusions of the second electrode measured along the first direction may get shorter along a direction away from a center of the discharge cells. The plasma display panel may include a first dielectric layer covering the address electrodes and a second dielectric layer covering the first and second electrodes, the first and second electrodes being formed on the first dielectric layer.

At least one of the above and other features and advantages of the invention may be separately realized by providing a flat display panel, including a first substrate, a second substrate opposite to the first substrate with a predetermined space between the first substrate and the second substrate, the predetermined space being partitioned into a plurality of discharge cells, first electrodes and second electrodes formed on the first substrate and extending along a first direction, address electrodes formed on the first substrate extending along a second direction, the first direction crossing the second direction, address electrode projections extending from the address electrodes toward an inner portion of corresponding ones of the discharge cells, and first electrode projections extending from the first electrodes toward respective inner portions of the corresponding ones of the discharge cells, wherein respective ones of the address electrode projections and first electrode projections overlap each other.

The flat panel display may further include second electrode projections extending from the second electrodes toward respective inner portions of the corresponding ones of the discharge cells, corresponding pairs of the first electrode projections and the second electrode projections may oppose each other along the second direction and corresponding pairs of the address electrode projections and the first electrode projections may face each other along a third direction substantially perpendicular to the first and second directions.

BRIEF DESCRIPTION OF THE DRAWINGS

The above and other features and advantages of the invention will become more apparent to those of ordinary skill in the art by describing in detail exemplary embodiments thereof with reference to the attached drawings, in which.

DETAILED DESCRIPTION OF THE INVENTION

Figure 1:
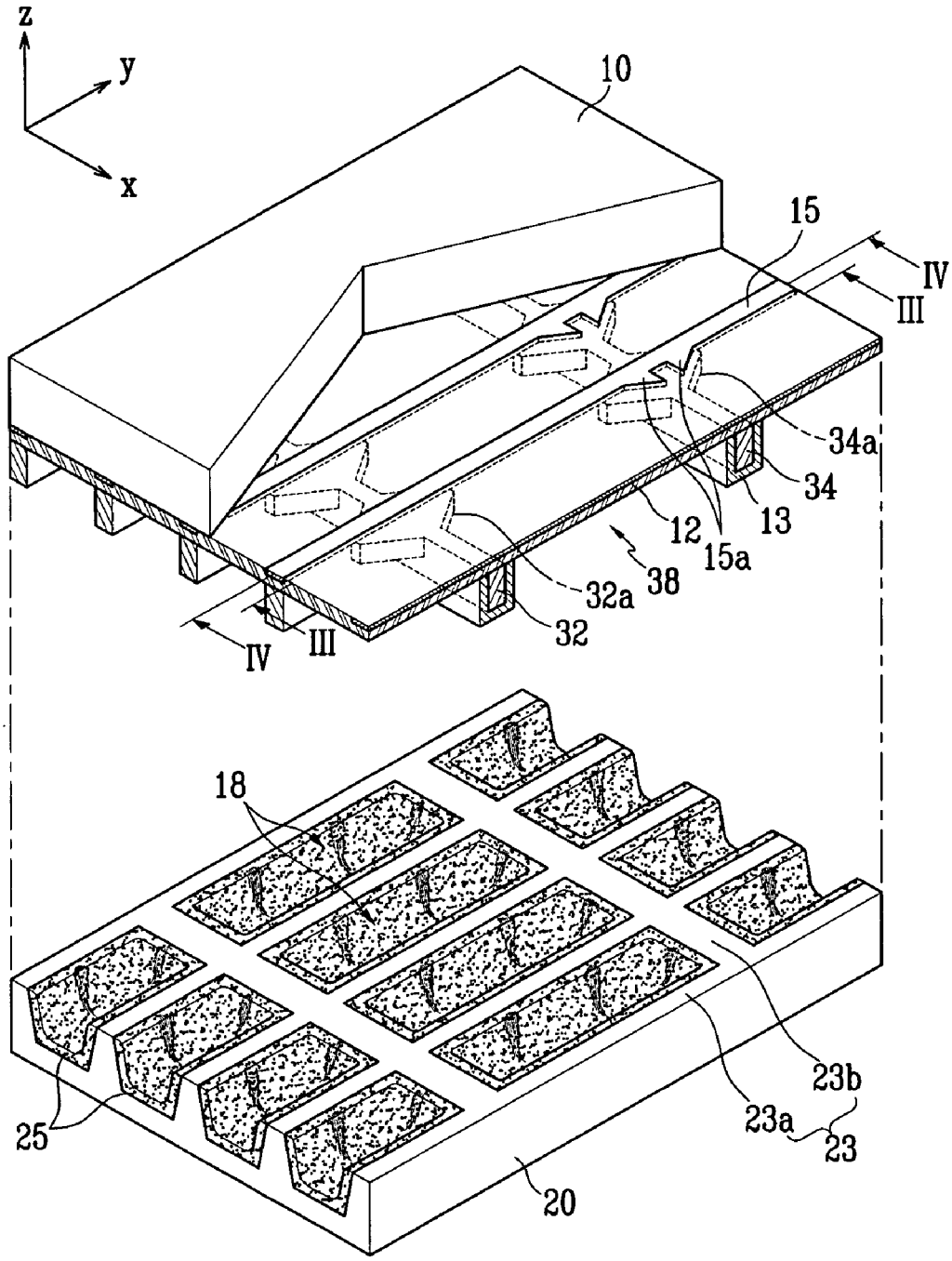
FIG. 1 illustrates a partial exploded perspective view of a PDP according to a first exemplary embodiment of the invention.

Korean Patent Application No. 10-2005-0074781, filed on Aug. 16, 2005, in the Korean Intellectual Property Office and entitled: "Plasma Display Panel", is incorporated by reference herein in its entirety.

The invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
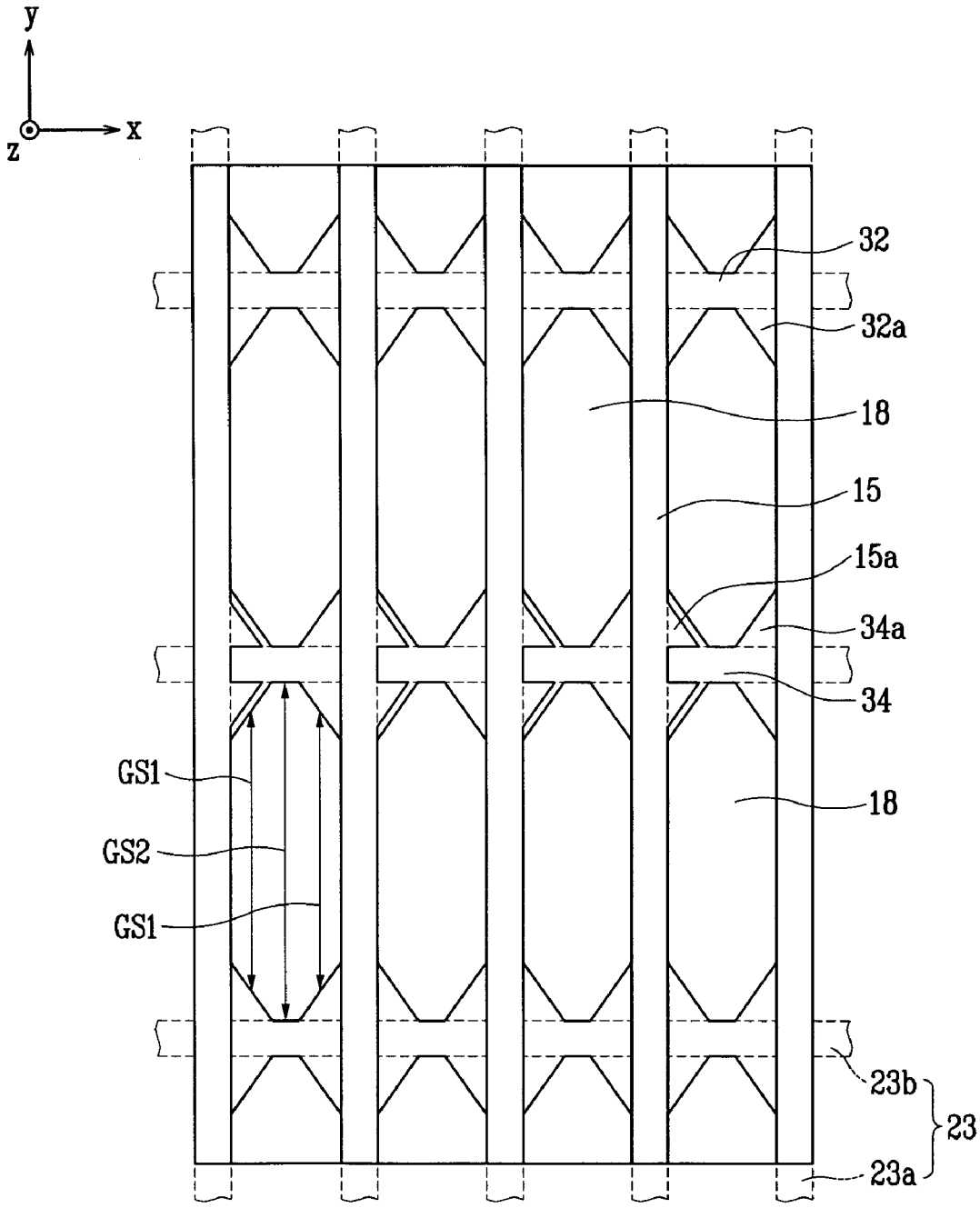
FIG. 2 illustrates a schematic of a partial plan view of a first exemplary embodiment of electrode structures and associated discharge cells employed in the exemplary PDP illustrated in FIG. 1.

FIG. 1 illustrates a partial exploded perspective view of a PDP according to a first exemplary embodiment of the invention, and FIG. 2 illustrates a schematic of a partial plan view of a first exemplary embodiment of electrode structures and associated discharge cells employed in the exemplary PDP illustrated in FIG. 1.

Referring to FIGS. 1-2, a PDP according to a first exemplary embodiment of the invention may include a first substrate 10 (hereinafter referred to as a "front substrate") and a second substrate 20 (hereinafter referred to as a "rear substrate") arranged opposite to each other with a predetermined gap therebetween.

A plurality of discharge cells 18 may be defined between the front substrate 10 and the rear substrate 20. The discharge cells 18 may be at least partially defined by barrier ribs 23. The barrier ribs 23 may be formed by etching the rear substrate 20. Discharge cells may be at least partially defined by respective portions of one or more separate barrier ribs.

The barrier ribs 23 may have first barrier rib members 23*a* and second barrier rib members 23*b*. The first barrier ribs members 23*a* may be formed to extend in a first direction, e.g., y-axis direction, and the second barrier rib members 23*b* may be formed to extend in a second direction, e.g., x-axis direction, crossing the first direction. The discharge cells 18 may be formed in a matrix pattern defined by the first barrier rib members 23*a* and the second barrier rib members 23*b* crossing each other, thereby reducing and/or preventing crosstalk between adjacent discharge cells 18.

In embodiments of the invention, the discharge cells 18 may be formed in a striped pattern by the first barrier rib members 23*a* extending in the first direction, e.g. y-axis direction. In embodiments, a planar shape of the discharge cells 18 may be a quadrangle. In embodiments, each discharge cell 18 may be formed in a shape of a quadrilateral prism that is open at top thereof.

The discharge cells 18 may be provided with a plasma gas, including, e.g., xenon Xe, neon Ne, etc., for the plasma discharge.

Phosphor layers 25 of, e.g., red, green, and blue colors may be formed in each discharge cell 18 to emit visible light of red, green, and blue colors. In embodiments, the phosphor layers 25 may be formed at bottom sides of the discharge cells 18 and lateral sides of the barrier ribs 23.

Address electrodes 15, first electrodes 32 (hereinafter referred to as "sustain electrodes"), and second electrodes 34 (hereinafter referred to as "scan electrodes") may be formed on the front substrate 10, corresponding to the discharge cells 18.

The address electrodes 15 may be formed to extend along the first direction, e.g., y-axis direction, on the front substrate 10, and may be arranged parallel to one another along the second direction, e.g., x-axis direction. The address electrodes 15 may be disposed to cross the discharge cells 18 at an upper portion thereof. For example, the address electrodes 15 may be disposed between the front substrate 10 and the barrier ribs 23, as illustrated in FIG. 1.

The address electrodes 15 may be formed to extend along the first direction, i.e., the y-axis direction. The address electrodes 15 may be formed on the front substrate 10 at positions corresponding to positions of the first barrier rib members 23*a*. For example, the address electrodes 15 may extend parallel to the first barrier rib members 23*a* and may directly overlap the first barrier rib members 23*a*, as illustrated in FIG. 2. In such embodiments, because the address electrodes 15 correspond to a non-discharge region, i.e., overlapping the first barrier rib members 23*a*, the address electrodes 15 may be formed on the front substrate 10, may not block visible light, and may be formed of a metal having good electrical conductivity. The address electrodes may select discharge cells 18 arranged at one side of the respective address electrode 15 along the second direction, i.e., x-direction.

The address electrodes 15 may have protrusions 15*a* protruding toward an inside of the discharge cell 18 from the address electrodes 15. The protrusions 15*a* of the address electrodes 15 may extend between boundaries between adjacent discharge cells 18 along the second direction, e.g., x-axis direction. In embodiments, the protrusions 15*a* may be formed at corners of the discharge cells 18. In embodiments, the protrusions 15*a* may have a triangular plan shape. Such arrangement of the protrusions 15*a* may minimize blocking of visible light generated in the discharge cells 18 during a sustain discharge.

In the exemplary embodiment illustrated in FIG. 2, the protrusions 15*a* may participate in an address discharge with the scan electrodes 34 to select respective ones of the discharge cells 18. In embodiments, the protrusions 15*a* may be formed to correspond to each of a pair of adjacent discharge cells 18 arranged along the first direction, i.e., y-axis direction, which may be associated with one of the scan electrodes 34 extending therebetween.

Referring to FIG. 2, the protrusions 15*a* may, together with the respective one of the address electrodes 15 and a respective one of the scan electrodes 24 select, i.e., engage in an address discharge of, the respective ones of the discharge cells 18 that are adjacent to the respective protrusion 15*a*. In the exemplary embodiment illustrated in FIG. 2, each of the protrusions 15*a* may engage in address discharge for the pair of discharge cells 18 arranged along the first direction, i.e., the y-direction, in a column. In embodiments, the protrusions 15*a* may engage in address discharge of each of the discharge cells 18 into which the protrusion 15*a* protrudes into the discharge space 38 thereof.

Accordingly, the protrusions 15*a* of the address electrodes 15 may participate in the address discharge in the pair of adjacent discharge cells 18 in the first direction, i.e., y axis direction.

A first dielectric layer 12 may be formed on a surface of the front substrate 10 to cover the address electrodes 15 and the protrusions 15*a* thereof. The first dielectric layer 12 may be formed on the entire surface of the front substrate 10 facing the second substrate 20. The first dielectric layer 12 may serve to protect the address electrodes 15 and/or to attach wall charges thereto. In embodiments, the first dielectric layer 12 may electrically insulate the address electrodes 15 from the sustain electrodes 32 and the scan electrodes 34.

Now, structures of the scan electrodes 34 and sustain electrodes employed in the first exemplary embodiment of the electrode structures illustrated in FIGS. 1 and 2 will be described with further reference to FIGS. 3-5.

Figure 3:
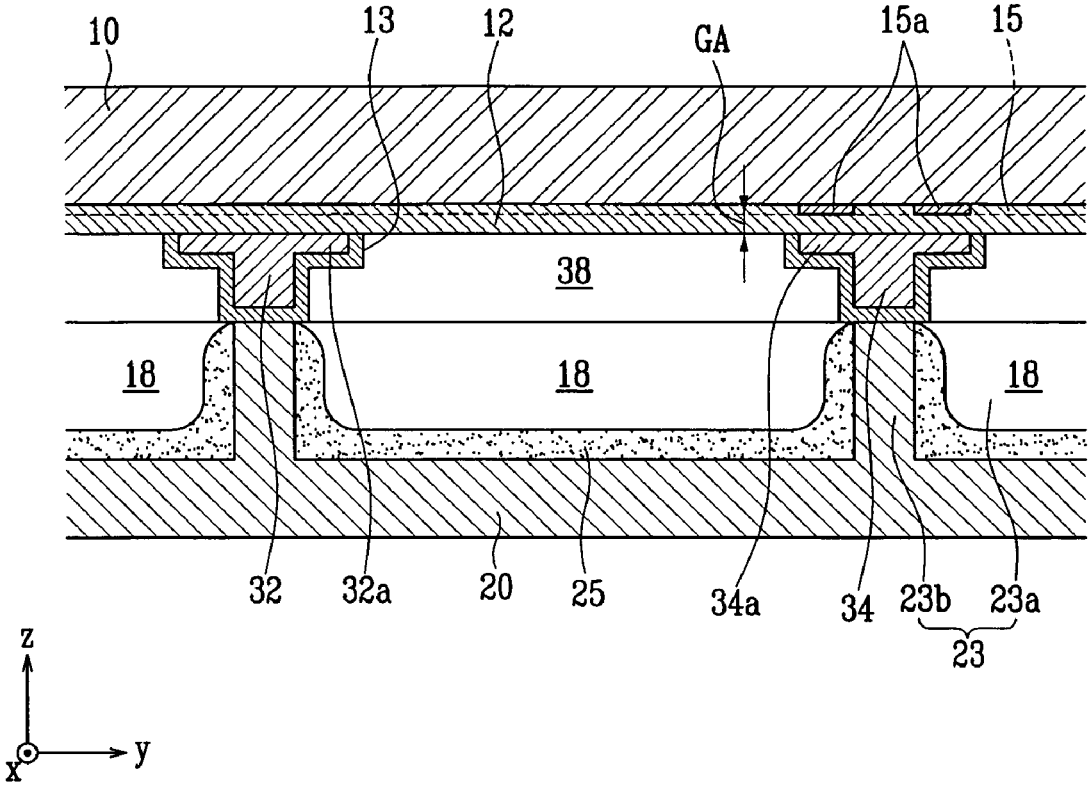
FIG. 3 illustrates a partial cross-sectional view taken along line III-III of the PDP illustrated in FIG. 1 during assembly of the PDP.
Figure 4:
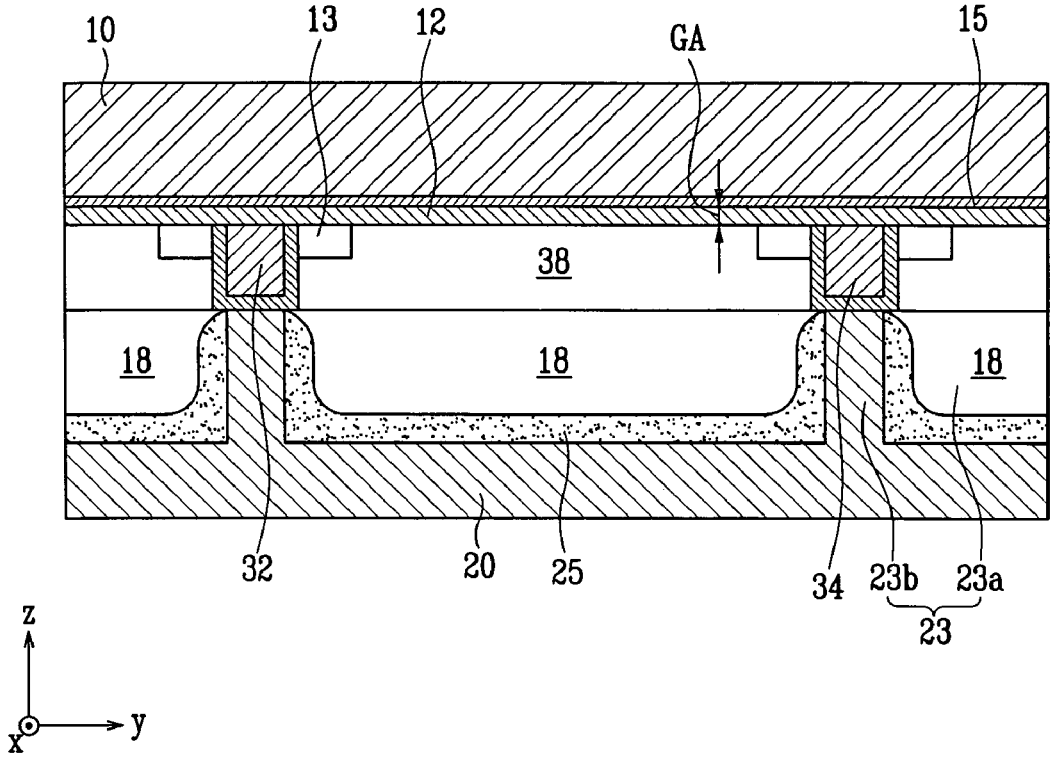
FIG. 4 illustrates a partial cross-sectional side view taken along line IV-IV of the PDP illustrated in FIG. 1 during assembly of the PDP.
Figure 5:
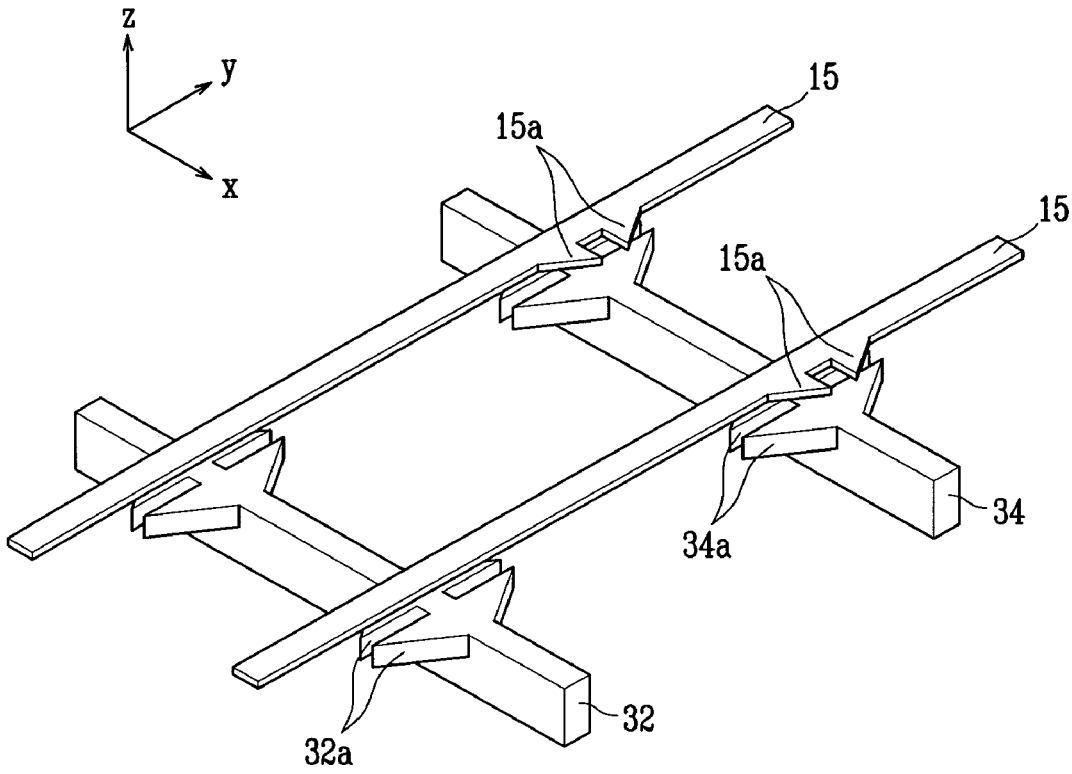
FIG. 5 illustrates a partial perspective view of the structure of the first exemplary electrode structure illustrated in FIG. 2.

FIG. 3 illustrates a partial cross-sectional view taken along line III-III of the PDP illustrated in FIG. 1 during assembly of the PDP, FIG. 4 illustrates a partial cross-sectional side view taken along line IV-IV of the PDP illustrated in FIG. 1 during assembly of the PDP, and FIG. 5 illustrates a partial perspective view of the structure of the first exemplary electrode structure illustrated in FIG. 2.

Referring to FIGS. 1-5, the sustain electrodes 32 and the scan electrodes 34 may be formed to extend along the second direction, i.e., x-axis direction, on the first dielectric layer 12 of the front substrate 10. As illustrated in FIGS. 3 and 4, the sustain electrodes 32 and the scan electrodes 34 may project from the first dielectric layer 12 toward the rear substrate 20 along, e.g., the third direction, e.g., z-axis direction. A space may exist between the front substrate, which may include the scan electrodes 34, the sustain electrodes 32 and the address electrodes 15, and the back substrate 20.

The sustain electrodes 32 and the scan electrodes 34 may be arranged opposite to each other to define a discharge gap of a discharge cell 18 therebetween. In embodiments, the sustain electrodes 32 and the scan electrodes 34 may be configured to have an opposing discharge structure. A position of each of the sustain electrodes 32 and the scan electrodes 34 may correspond to a respective one of the second barrier rib members 23*b*, and may be alternately arranged along the first direction, i.e., y-axis direction. That is the sustain electrodes 32 and the scan electrodes 34 may extend along the second direction, i.e., and may be alternately arranged so as to have spaces therebetween along the first direction, i.e., y-axis direction.

A pair of adjacent discharge cells 18 arranged along the first direction may share a respective one of the sustain electrodes 32 and the scan electrodes 34. That is, the each of the scan electrodes 32 and the sustain electrodes 34 may engage in the sustain-discharge of each cell adjacent thereto along the first direction, i.e., y-axis direction. Each of the sustain electrodes 32 and each of the scan electrodes 34 may participate in the sustain-discharge of a respective pair of adjacent ones of the discharge cells 18.

In embodiments, a distance between, e.g., the first panel 10 and the second panel 20 along a third direction, i.e., z-axis direction, may be greater than a distance between adjacent ones of the scan electrodes 34 and sustain electrodes 32 along the first direction, i.e., y-axis direction.

In embodiments of the invention, the sustain electrodes 32 and the scan electrodes 34 may be configured to have an opposing discharge structure. Such an opposing discharge structure may enable the luminous efficiency can be enhanced during the sustain discharge.

In such an opposing structure, areas of respective ones of the sustain electrodes 32 and the scan electrodes 34 opposing each other may be increased. By increasing such a facing area of opposing ones of the scan electrodes 32 and sustain electrodes 34, strong vacuum UV (VUV) light may be generated at discharge. The strong vacuum UV (VUV) light may effectively collide with the phosphor layers 25, thereby emitting visible light.

During an address period, address pulses may be applied to the address electrode 15 and scan pulses may be applied to the scan electrodes 34. An address discharge may occur as a result of the address pulses and the scan pulses, and a respective discharge cell 18 may be selected to be turned on during a subsequent sustain period. During a sustain period, sustain pulses may be applied to the sustain electrodes 32 and the scan electrodes 34, and a sustain discharge may occur between the sustain and scan electrodes 32 and 34. As a result of a sustain discharge, an image may be displayed in the respective discharge cell 18. The scan electrodes 34 and the sustain electrodes 32 may serve different functions according to characteristics of pulses applied thereto. The invention is not limited thereto.

In embodiments of the invention employing an address electrode structure according to one or more aspects of the invention, only the scan electrodes 34 and/or both the scan electrodes 34 and the sustain electrodes 32 may include protrusions 34*a*, 32*a*. In embodiments in which both the scan electrodes 34 and the sustain electrodes 32 include protrusions 34*a*, 32*a*, facing ones of the protrusions 32*a* of the sustain electrodes 32 and the protrusions 34*a* of the scan electrodes 34 may be formed to protrude toward each other.

In embodiments of the invention, the protrusions 32*a*, 34*a* may have a triangular plane shape at corners of the discharge cells 18. The protrusions 34*a* of the scan electrodes 34 may be formed to correspond to the protrusions 15*a* of the address electrodes 15. For example, the protrusions 34*a* of the scan electrodes 34 may have a same size and/or a same shape as the protrusions 15*a* of the address electrodes 15. In embodiments, such as the exemplary embodiment illustrated in FIG. 2, the protrusions 34*a* of the scan electrodes 34 may be larger than the protrusions 15*a* of the address electrodes 15.

In embodiments of the invention, the scan electrode protrusions 34*a* may be formed to correspond to the address electrode protrusions 15*a*, where respective ones of the scan electrode protrusions 34*a* and the address electrode protrusions 15*a* may partially or completely overlap each other. The respective ones of the scan electrode protrusions 34*a* and the address electrode protrusions 15*a* may be spaced apart from each other along the third direction, i.e., z-axis direction. Thus, embodiments of the invention increase respective facing areas between corresponding ones of the address electrodes 15 and the scan electrodes 34, thereby facilitating address discharge.

As illustrated in FIG. 2, a width of the protrusions 32*a*, 34*a* along a first direction, i.e., y-axis direction, may be largest at a boundary between the protrusions 32*a*, 34*a* and the respective scan electrode 34 or sustain electrode 32. Thus, a width of the protrusions 32*a*, 34*a* along a first direction, i.e., y-axis direction, may decrease as the protrusion 34*a*, 32*a* extends further into the discharge space 38 of the respective discharge cell 18. In embodiments of the invention having, e.g., triangular shaped protrusions 34*a*, 32*a*, a width of the protrusions 32*a*, 34*a* along the second direction, x-axis direction, may have characteristics similar to characteristics of the width of the protrusions 32*a*, 34*a* along the first direction, i.e., y-axis direction.

In embodiments, as shown in FIGS. 2 and 5, e.g., the sustain electrode protrusions 32*a* may be formed to oppose the scan electrode protrusions 34*a*. As described above, the protrusions 15*a*, 32*a* and 34*a* may be formed, e.g., at corners of the discharge cell 18 and may, e.g., have a triangular plane shape.

Referring to FIG. 2, a distance between the sustain electrode protrusions 32*a* and the scan electrode protrusions 34*a* may be formed to get shorter going along a direction away from a center of a discharge cell 18. Accordingly, a first discharge gap GS1 (hereinafter, referred to as a "short discharge gap") and a second discharge gap GS2 (hereinafter referred to as a "long discharge gap") may be formed between the sustain electrodes 32 and the scan electrodes 34. The short discharge gap GS1 may be formed between the sustain electrode protrusions 32*a* and the scan electrode protrusions 34*a* at, e.g., both sides of the discharge cell 18 along, e.g., the second direction, i.e., x-axis direction. The long discharge gap GS2 may be formed between the sustain electrodes 32 and the scan electrodes 34, i.e. about the center of the discharge cell 18.

Accordingly, the sustain discharge is initiated with a low voltage in the short discharge gap GS1, and the sustain discharge may be diffused into the long discharge gap GS2, thereby enhancing discharge efficiency.

In embodiments of the invention, the address electrodes 15 and the scan electrodes 34 may be formed on the front substrate 10, and as illustrated in FIGS. 3 and 4, because of the address electrode protrusions 15*a* and scan electrode protrusions 34*a*, a discharge gap GA between the address electrodes 15 and the scan electrodes 34 may be reduced relative to known PDP electrode structures.

As illustrated in FIG. 3, the protrusions 34*a*, 32*a* may be formed on the first dielectric layer 12 of the front substrate 10, and may continuously extend from a portion of the respective scan electrode 34 or sustain electrode 32. In embodiments of the invention, the protrusions 34*a*, 32*a* may extend from an upper end of the respective scan electrode 34 or sustain electrode 32, which may be formed on the first dielectric layer 12. Embodiments of the invention are not, however, limited to such a structure.

As illustrated in FIG. 3, in embodiments, the address electrodes 15, the scan electrodes 34 and the sustain electrodes 32 may all the be arranged completely above the barrier ribs 23 and/or the phosphor 25, along, e.g., the third direction, i.e., the z-axis direction.

Embodiments of the invention may thus enable an address discharge between the address electrodes 15 and the scan electrodes 34 to occur with a low voltage. Embodiments of the invention separately enable a reduced discharge gap GA between the address electrodes and the scan electrodes 34 by providing scan electrode protrusions 34*a* adjacent to the front substrate 10, thereby facilitating the address discharge.

The protrusions 34*a* of the scan electrodes 34 may be formed to correspond to each of a pair of adjacent discharge cells 18 along the first direction, i.e., y-axis direction, with the scan electrodes 34 therebetween. The protrusions 34*a* of the scan electrodes 34 may engage in the address discharge in the pair of adjacent discharge cells 18 in the first direction. In embodiments, the protrusions 34*a* of the scan electrodes 34 may be formed to correspond to each of a pair of adjacent discharge cells 18 along the second direction, i.e., x-axis direction.

The sustain electrode protrusions 32*a* may be formed during a same process and/or to have a same structure as the scan electrode protrusions 34*a*.

A second dielectric layer 13 may be formed on the first dielectric layer 12 of the front substrate 10. The sustain electrodes 32 and the scan electrodes 34 may be covered with the second dielectric layer 13. The second dielectric layer 13 may have a structure corresponding to the barrier ribs 23, thereby forming discharge spaces 38 at front substrate 10 side. In embodiments of the invention, the discharge spaces 38 may be defined by bottom surfaces of the first dielectric layer 12 and side surfaces of the second dielectric layer 13.

A protective layer (not shown) made of, e.g., an MgO may be formed on the discharge spaces 38, i.e., on the bottom surfaces of the first dielectric layer 12 and on the side surfaces of the second dielectric layer 13.

In the exemplary embodiments illustrated in the accompanying Figures, the scan electrode protrusions 34*a* and the address electrode protrusions 15*a* correspond to a pair of adjacent discharge cells 18 in the first direction, i.e., y-axis direction. Accordingly, in order to drive the PDP according to the illustrated exemplary embodiments, the sustain electrodes 32 may be divided into an even-numbered electrode group and an odd-numbered electrode group.

That is, sustain pulses may be applied separately to the odd-numbered sustain electrodes and the even-numbered sustain electrode group, and thereby the sustain discharge may independently occur in each discharge cell 18. However, the sustain pulses may be applied simultaneously to the odd-numbered sustain electrodes and the even-numbered sustain electrode group. In this case, a sustain discharge may occur in a pair of discharge cells 18 adjacent in the first direction.

Figure 6:
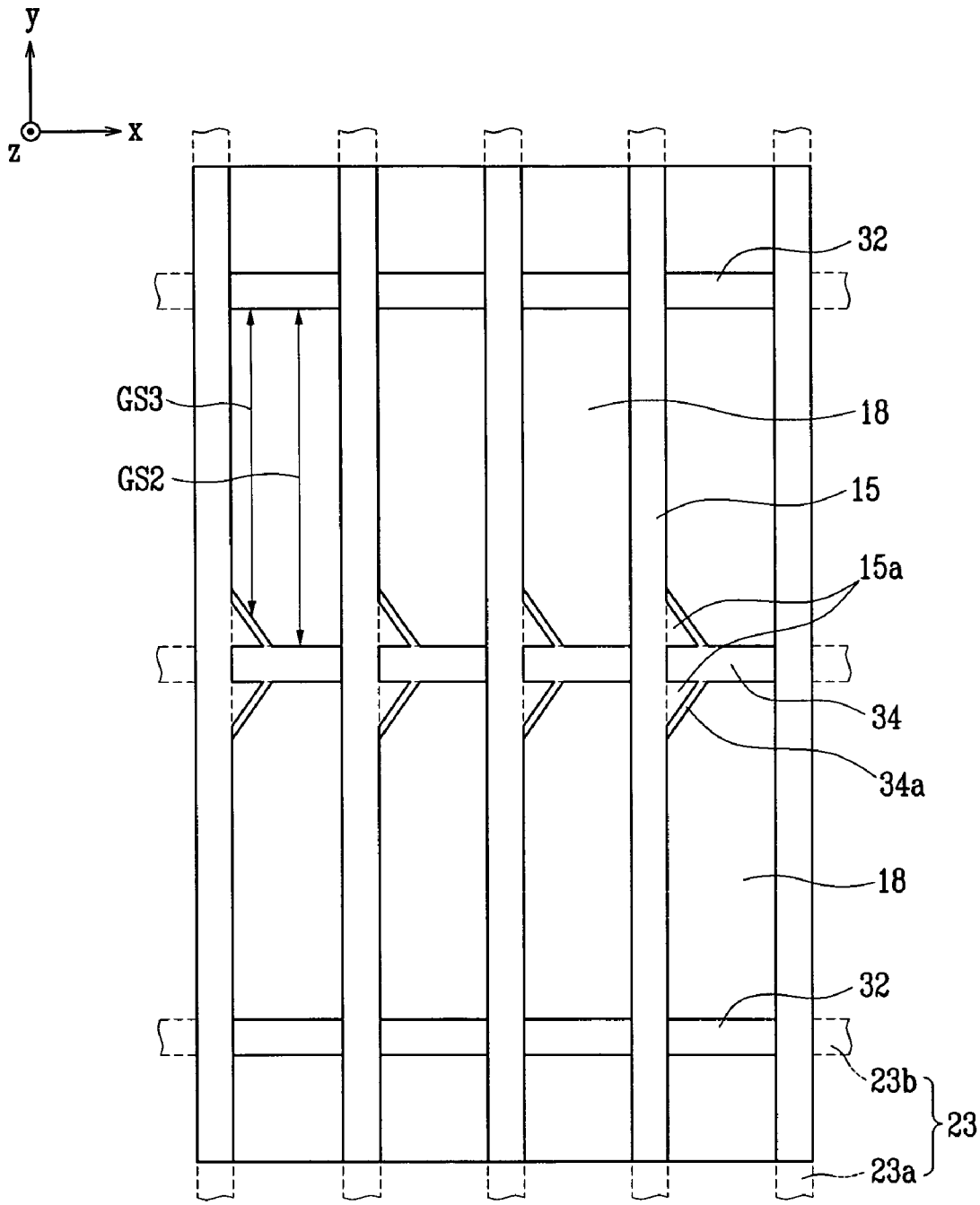
FIG. 6 illustrates a schematic of a partial plan view of a second exemplary embodiment of electrode structures associated discharge cells.

FIG. 6 illustrates a schematic of a partial plan view of a second exemplary embodiment of electrode structures and associated discharge cells.

Referring to FIG. 6, in embodiments of the invention, unlike the first exemplary embodiment illustrated in FIGS. 1-5, scan electrode protrusions 34*a* may only be formed only in the scan electrodes 34 and not on the sustain electrodes 32. In such embodiments, a third discharge gap GS3 may be formed between the sustain electrodes 32 and the scan electrode protrusions 34*a*.

Since the third discharge gap GS3 is formed, a sustain discharge between the sustain electrodes 32 and the scan electrodes 34 may be initiated with a low voltage. The sustain discharge may be diffused into the long discharge gap GS2, thereby enhancing discharge efficiency.

As described above, in PDPs employing one or more aspects of the invention, address electrodes provided with protrusions may be formed on the front substrate. In addition, scan and sustain electrodes provided with protrusions may be spaced apart from the address electrodes on the front substrate, and may be formed opposite to each other with a discharge space interposed therebetween. In embodiments of the invention, address discharge between the address electrodes and the scan electrodes may be facilitated with a low voltage, thereby reducing address power consumption. In embodiments, discharge efficiency and luminous efficiency may be increased by providing a short discharge gap between the protrusions of the scan electrodes and the protrusions of the sustain electrodes, and a relatively longer discharge gap between the scan electrodes and the sustain electrodes.

Exemplary embodiments of the invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the sprit and scope of the invention as set forth in the following claims.

What is claimed is:

1. A plasma display panel, comprising:

a first substrate;

a second substrate opposite to the first substrate with a predetermined space therebetween, the space being partitioned into a plurality of discharge cells;

a phosphor layer in the discharge cells;

address electrodes extending in a first direction on the first substrate to correspond to the discharge cells; and a first electrode and a second electrode extending in a second direction crossing the first direction on the first substrate, spaced apart from the address electrodes, arranged opposite to each other, and projecting toward the second substrate with a discharge space formed therebetween, wherein the address electrodes include protrusions disposed adjacent to the second electrodes and protruding toward the inside of the discharge cells, wherein at least one of the first electrode and the second electrode includes protrusions protruding toward an inside of a respective one of the discharge cells, and wherein at least a portion of the adjacent ones of the address electrode protrusions, respectively corresponding to adjacent ones of the discharge cells, are spaced apart from each other in a region overlapping the corresponding one of the first electrodes and the second electrodes.

2. The plasma display panel as claimed in claim 1, wherein the address electrodes are disposed on boundaries between adjacent discharge cells in the second direction.

3. The plasma display panel as claimed in claim 2, wherein the protrusions of the address electrodes are formed at corners of the discharge cells.

4. The plasma display panel as claimed in claim 3, wherein the protrusions of the address electrodes have a triangular plan shape.

5. The plasma display panel as claimed in claim 3, wherein the protrusions of the address electrodes are formed to correspond to each of a pair of adjacent discharge cells in the first direction with the second electrode therebetween.

6. The plasma display panel as claimed in claim 1, wherein the protrusions of the second electrode are formed at corners of the discharge cells.

7. The plasma display panel as claimed in claim 6, wherein the protrusions of the second electrode have a triangular plan shape.

8. The plasma display panel as claimed in claim 6, wherein the protrusions of the second electrode are formed to correspond to the protrusions of the address electrodes.

9. The plasma display panel as claimed in claim 6, wherein the protrusions of the second electrode are formed to correspond to each of a pair of adjacent discharge cells in the first direction with the second electrode therebetween.

10. The plasma display panel as claimed in claim 1, wherein the protrusions of the second electrode are disposed adjacent to the first substrate.

11. The plasma display panel as claimed in claim 1, wherein the protrusions of the second electrode are formed to correspond to each of a pair of adjacent discharge cells in the second direction.

12. The plasma display panel as claimed in claim 1, wherein a distance between the first electrode and the protrusions of the second electrode measured in the first direction gets shorter going along a direction away from a center of the discharge cells.

13. The plasma display panel as claimed in claim 1, wherein a distance between the protrusions of the first electrode and the protrusions of the second electrode measured along the first direction gets shorter along a direction away from a center of the discharge cells.

14. The plasma display panel as claimed in claim 1, further comprising a first dielectric layer covering the address electrodes and a second dielectric layer covering the first and second electrodes, the first and second electrodes being formed on the first dielectric layer.

15. The plasma display panel as claimed in claim 1, wherein the adjacent ones of the first and second electrode protrusions are spaced apart from each other defining a fork-like structure in a region overlapping a respective one of the address electrodes.

16. The plasma display panel as claimed in claim 6, wherein the protrusions of the first electrode are formed at corners of the discharge cells.

17. The plasma display panel as claimed in claim 16, wherein the protrusions of the first electrode have a triangular plan shape.

18. The plasma display panel as claimed in claim 16, wherein the protrusions of the first electrode are disposed opposite to the protrusions of the second electrode.

19. The plasma display panel as claimed in claim 16, wherein the protrusions of the first electrode correspond to each of a pair of adjacent discharge cells in the first direction with the first electrode therebetween.

20. A flat display panel, comprising:

a first substrate;

a second substrate opposite to the first substrate with a predetermined space between the first substrate and the second substrate, the predetermined space being partitioned into a plurality of discharge cells;

first electrodes and second electrodes on the first substrate and extending along a first direction;

address electrodes on the first substrate extending along a second direction, the first direction crossing the second direction;

address electrode projections extending from the address electrodes toward an inner portion of corresponding ones of the discharge cells;

first electrode projections extending from the first electrodes toward respective inner portions of the corresponding ones of the discharge cells; and second electrode projections extending from the second electrodes toward respective inner portions of the corresponding ones of the discharge cells, wherein respective ones of the address electrode projections and first electrode projections overlap each, corresponding pairs of the first electrode projections and the second electrode projections oppose each other along the second direction, and corresponding pairs of the address electrode projections and the first electrode projections face each other along a third direction substantially perpendicular to the first and second directions.

* * * * *